United States Patent [19]

Münch et al.

[11] Patent Number: 4,915,789

[45] Date of Patent: Apr. 10, 1990

[54] APPARATUS FOR ADJUSTING A DIAPHRAGM BLADE

[75] Inventors: Rudolf Münch, Ravensburg; Peter Ficklscherer, Baindt-Sulpach, both of Fed. Rep. of Germany

[73] Assignee: Sulzer-Escher Wyss GmbH, Ravensburg, Fed. Rep. of Germany

[21] Appl. No.: 322,296

[22] Filed: Mar. 13, 1989

[30] Foreign Application Priority Data

Mar. 11, 1988 [DE] Fed. Rep. of Germany ..... 3808050

[51] Int. Cl.[4] ..... D21F 1/06

[52] U.S. Cl. ..... 162/259; 162/262; 162/344

[58] Field of Search ..... 162/258, 259, 262, 336, 162/344; 425/466; 364/471

[56] References Cited

U.S. PATENT DOCUMENTS

| | | | |
|---|---|---|---|
| 3,463,701 | 8/1969 | Curtis | 162/259 |
| 4,726,883 | 2/1988 | Schroeder | 162/259 |
| 4,741,686 | 5/1988 | Cazzani et al. | 425/466 |

FOREIGN PATENT DOCUMENTS

| | | |
|---|---|---|
| 0189311 | 7/1986 | European Pat. Off. . |
| 3535849 | 9/1987 | Fed. Rep. of Germany . |

OTHER PUBLICATIONS

German Technical Journal "Das Papier", 35th year, No. 10, 1981, pp. 445 through 452: Technical paper of Heiner Kiessling entitled "Technical Progress Headbox—Anti—Deflection Control and Lip Plate Loading".

"New System Control CMD Basis Weight Profile Automatically", Paper Trade Journal, pp. 34–36, Nov. 1971.

*Primary Examiner*—Karen M. Hastings

*Attorney, Agent, or Firm*—Werner W. Kleeman

[57] ABSTRACT

For uniform and regular adjustment of a diaphragm blade within the elastic deformability thereof, the diaphragm blade provided at the slice opening of a headbox of a papermaking machine is movable by means of adjusting elements driveable by adjustment motors. The adjusting elements are arranged in an appropriate spaced relationship substantially parallel to the diaphragm blade and coupled therewith in order to apply a force upon the diaphragm blade at connecting locations thereof. At each of the adjustment motors there can be individually set or adjusted during an adjusting operation prior to starting the adjustment motors the momentarily desired thrust speed and the momentarily desired thrust distance or travel for the respective adjusting element. All adjustment motors are simultaneously started and simultaneously stopped subsequent to reaching the desired position or location of the diaphragm blade. Electric step motors operating in a fixed cycle are particularly suitable for simultaneously starting and simultaneously stopping the adjusting operation. The apparatus and the therewith performable adjusting operation are controllable and programmable by known electronic means.

2 Claims, 2 Drawing Sheets

APPARATUS FOR ADJUSTING A DIAPHRAGM BLADE

BACKGROUND OF THE INVENTION

The present invention broadly relates to a headbox for a papermaking machine and, more specifically pertains to a new and improved apparatus for adjusting a diaphragm blade or the like at an outlet gap or slice or slice opening of a headbox.

Generally speaking, the apparatus of the present invention is of the type comprising driveable adjusting elements which are arranged in an appropriate spaced relationship substantially parallel to the diaphragm blade and coupled with the latter in order to apply at connection locations a force upon the diaphragm blade. The adjusting elements are supported at a rigid stationary support or carrier.

As is known to the art, the diaphragm blade or leaf is designed to be displaceable vertically or perpendicular to the paper stock flow in the outlet gap or slice or slice opening of the papermaking machine and serves for the adjustment of the clearance or inner width or height of the outlet gap or slice over the entire width or cross-machine extent thereof. The adjustment of the diaphragm blade from an actual position or location to a reference or set position or location is accomplished, while undergoing elastic deformation of the diaphragm blade in the region of the connecting locations between the adjusting elements and the diaphragm blade, by applying the required force. Such force is applied via the adjusting elements which are moved or displaced in a corresponding direction through a corresponding thrust distance or travel and stopped and arrested after reaching the predetermined end points or terminal locations of the reference position of the diaphragm blade.

According to a prior art adjusting technique or method with the hitherto used apparatus, the adjusting elements are moved either individually or in groups or collectively during a collective simultaneous movement of several adjusting elements, all such adjusting elements having approximately the same thrust speed, with the exception of possible acceleration or deceleration operations. Since the thrust distances to be covered for adjusting a reference position of the diaphragm blade or leaf, particularly according to a curve, are of different lengths, some end points or terminal locations are reached earlier than others at the same thrust speed for all involved adjusting elements. In the region of each end point or terminal location already reached, undesired bending stress can occur in the diaphragm blade. Such bending stress can possibly lead to a permanent plastic deformation of the diaphragm blade or leaf, although the diaphragm blade adjustment to be performed from the actual position or location to the reference position or location thereof would lie in any event in the range of the elastic deformability of the diaphragm blade.

SUMMARY OF THE INVENTION

Therefore, with the foregoing in mind it is a primary object of the present invention to provide a new and improved construction of an apparatus for adjusting a diaphragm blade or leaf or the like which does not suffer from the aforementioned drawbacks and shortcomings of the the prior art constructions.

Another and more specific object of the present invention aims at the provision of a new and improved construction of an apparatus for adjusting a diaphragm blade or leaf which renders possible an adjusting operation by means of which the unnecessary or undesirable bending stress in the diaphragm blade during the adjusting operation is avoided.

Yet a further significant object of the present invention is directed to an improved apparatus for adjusting a diaphragm blade or leaf, which apparatus is simple in design, relatively economical to manufacture, extremely reliable in operation, not readily subject to malfunction and requires a minimum of maintenance.

Now in order to implement these and still further objects of the invention, which will become more readily apparent as the description proceeds, the apparatus for adjusting a diaphragm blade or leaf or the like of the present invention is, among other things, manifested by the features that adjustment motors are provided for driving the adjusting elements, that at each of these adjustment motors there can be individually set or adjusted in each case the desired thrust speed and the desired thrust distance or travel to be covered for the respective adjusting element prior to starting the adjustment motors, and that all adjustment motors are simultaneously placed into operation and simultaneously turned off subsequent to reaching a predetermined or desired reference or set position or location of the diaphragm blade or leaf.

With this construction of the apparatus for adjusting a diaphragm blade or leaf the control of the adjustment motors can be programmed such that all the adjusting elements simultaneously and within a predetermined time interval cover the thrust distances of possibly different length to the end points or terminal locations at the thrust speeds which in each case are directly proportionally adjusted or regulated to the lengths of the respective thrust distances. In such manner, the diaphragm blade or leaf is uniformly and regularly bent or flexed across its entire width solely within the range of its elastic deformability, so that no unnecessary bending stress can occur.

In an advantageous exemplary embodiment of the apparatus for adjusting a diaphragm blade or leaf constructed according to the invention, adjusting spindles are used as the adjusting elements and electric step motors are used as the adjustment motors. The number of steps and the frequency thereof for the time interval of an adjusting operation is adjustable at such electric step motors, and all electric step motors are simultaneously actuatable during the adjusting operation during such time interval.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
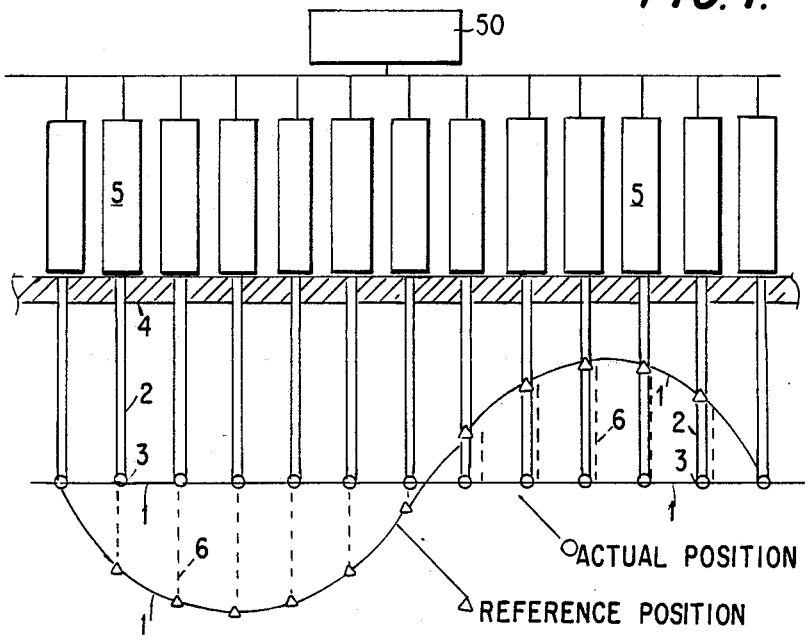
FIG. 1 is a schematic front view of an exemplary embodiment of apparatus for adjusting a diaphragm blade or the like constructed according to the invention and shows the actual position and the reference position of the diaphragm blade.

Describing now the drawings, it is to be understood that to simplify the showing thereof, only enough of the construction of the apparatus for adjusting a diaphragm blade or leaf or the like has been illustrated therein as is needed to enable one skilled in the art to readily understand the underlying principles and concepts of this invention. Turning attention now specifically to FIG. 1 of the drawings, the apparatus for adjusting an elastic diaphragm blade or leaf 1 illustrated therein by way of example and not limitation is arranged at an outlet gap or slice or slice opening of a headbox of a papermaking machine not particularly shown in the drawing. The elastic diaphragm blade or leaf 1 is illustrated in the drawings by a full line. The headbox is also not particularly shown in the drawings.

Driveable adjusting or adjustment elements 2 are provided for displacing or shifting the elastic diaphragm blade or leaf 1. Such driveable adjusting elements 2 are arranged in a suitable spaced relationship substantially parallel to the elastic diaphragm blade or leaf 1 and coupled with the latter. A force is thus introduced or applied at connecting locations or points 3 upon the diaphragm blade or leaf 1. The driveable adjusting elements 2 are supported at a rigid stationary support or carrier 4. Adjustment motors 5 are provided for the drive of the driveable adjusting elements 2. Such adjustment motors 5 are adjustable or controllable such that at each of the adjustment motors 5, for an adjusting operation to be performed, a respective desired thrust speed v for the duration of the adjusting operation, i.e. a time interval t, is adjustable or settable in each case prior to the start of the respective adjustment motor 5. The driveable adjusting elements 2 are collectively and simultaneously startable or disengagable after reaching in each case a desired reference position or location. In this manner, a desired thrust distance or travel 6 is covered in the time interval t by each connecting location 3.

The driveable adjusting elements 2 are advantageously structured as rotatable adjusting spindles, and electric step or stepping motors, defined by the adjustment motors 5, operating in a fixed-cycle or rhythm are used for the drive of such rotatable adjusting spindles. There are adjustable the number of steps required for covering the desired thrust distance or travel 6 and the frequency of such steps within the desired time interval t, during which the respective thrust distance or travel 6 is to be covered and from which the desired thrust speed is derived. The adjustment motors 5 are collectively and simultaneously movable for each individual adjusting operation during the time interval t which is the same for all adjustment motors 5.

With this construction of the apparatus for adjusting the diaphragm blade or leaf 1, the adjusting operation is performed in the following manner:

As depicted in the drawings, each actual position or location of the connecting locations or points 3 of the diaphragm blade or leaf 3 is schematically indicated by a small circle and each desired end position or terminal location of the connecting locations 3 of the diaphragm blade or leaf 2 is schematically indicated by a small triangle. For each adjusting spindle 2 the thrust distance or travel to be covered from the actual position or location to the desired reference end position or location is calculated and the number of steps required for covering the calculated thrust distance or travel 6 is fed into the associated or respective adjustment motor 5. There is then infed the frequency of the steps in the time interval t, within which the thrust distance or travel 6 must be covered. This time interval t for one adjusting operation is the same for all adjusting spindles 2, so that the individual adjusting spindles 2 are moved or displaced at different thrust speeds v while covering thrust distances 6 of possibly different lengths during the predetermined time interval t.

In other words, the adjusting spindles 2 which must cover a shorter thrust distance or travel 6 are moved slower, and the adjusting spindles 2 which must cover a longer thrust distance or travel 6 are moved faster. After a simultaneous start of the adjustment motors 5, all adjusting spindles 2 thus reach within the same time interval t and therefore at the same moment the desired reference end positions or locations intended to be reached by such adjusting spindles 2. This operation is particularly clearly depicted in the diagram in FIG. 4 with reference to an example concerning two adjusting spindles $2^1$ and $2^2$. For the adjusting spindle $2^1$ a calculated thrust distance or travel is designated by the reference numeral $6^1$, and for the adjusting spindle $2^2$ a calculated thrust distance or travel is designated by the reference numeral $6^2$. The number of steps and the step frequency are fed to the associated or respective adjustment motors 5.

Figure 4:
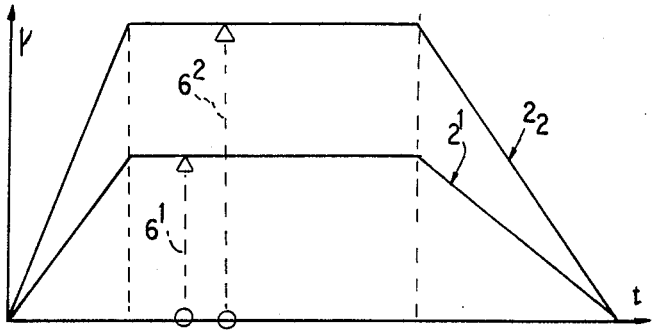
FIG. 4 shows a diagram of the movements of two adjusting elements during a predetermined time interval.

It is evident from FIG. 4 of the drawings that the adjusting spindle $2^2$ must be moved faster than the adjusting spindle $2^1$. The ratio of the thrust speeds v is directly proportional to the ratio of the length of the thrust distances $6^1$ and $6^2$, respectively. After a collective simultaneous start of the adjustment motors 5, there can follow, if need be, an acceleration phase until the adjusted or regulated thrust speeds v are reached. The reference end positions or locations are reached within the time interval t. After collectively turning off the adjustment motors 5, there can follow, if need be, a braking or deceleration phase until standstill or stoppage of the adjustment motors 5 or of the adjusting spindles $2^1$ or $2^2$, respectively.

Figure 2:
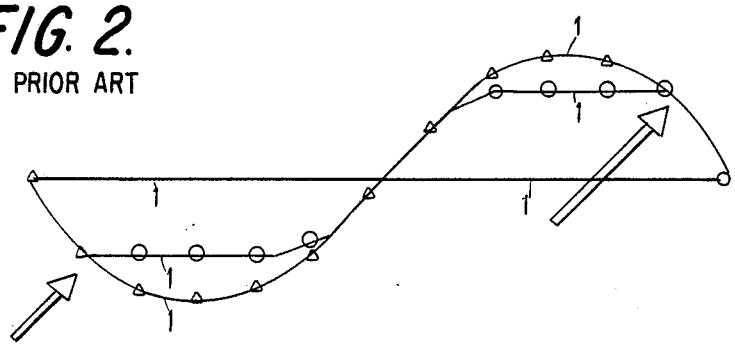
FIG. 2. PRIOR ART
FIG. 2 shows a diagram of the adjusting operation according to a prior art adjusting technique or process.

The advantage of the inventive adjusting operation clearly is evident from a comparison with the heretofore known adjusting operation schematically illustrated in FIG. 2. The abovedescribed inventive adjusting operation is schematically shown in the diagram illustrated in FIG. 3. Both illustrations or diagrams show in each case the situation in which the adjusting operation is not yet completed. Since according to the heretofore known adjusting operation all adjusting spindles 2 are moved or displaced at the same thrust speed, the adjusting spindles 2 cover, within the same time interval, a thrust distance or travel of equal length. Since the reference end position or location at some points is reached earlier than at other points, locations of buckling or kinking, designated by arrows in FIG. 2, occur at certain actually momentarily reached end positions or locations. At such locations of buckling, undesired bending stress occurs in the diaphragm blade or leaf 1. Such bending stress can exceed the elastic deformability of the diaphragm blade or leaf 1 and can lead to detrimental plastic deformation of the blade or leaf 1.

Figure 3:
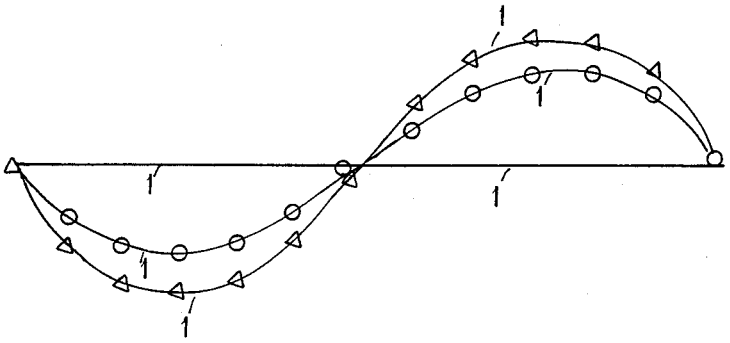
FIG. 3 shows a diagram of the adjusting operation according to the inventive adjusting technique or process.

By way of contrast the adjusting spindles 2 are moved with different thrust speeds in accordance with the inventive adjusting operation depicted in FIG. 3, so that the adjusting spindles 2 cover thrust distances of different lengths within the same time interval. The diaphragm blade or leaf 1 is thus uniformly and regularly deformed within its elastic deformability and without excessive or undue bending stress occurring at some location or other of the diaphragm blade 1.

Exemplary embodiments are also conceivable in which the settable adjustment motors 5 driving the adjusting elements 2 constitute hydraulic or pneumatic cylinder-and-piston units or are based on the action of piezo-electric forces.

As is readily understandable for one skilled in the art, the suggested adjusting operation and the apparatus for adjusting the diaphragm blade or leaf are controllable and programmable by known electronic means generally indicated in FIG. 1 by reference character 50 and constitute means for individually setting each of the electric stepping adjustment motors 5 to the predetermine number of steps and the frequency thereof for a predetermined time interval of an adjusting operation such that the electric stepping adjustment motors during the adjusting operation are collectively and simultaneously actuatable during the predetermined time interval.

While there are shown and described present preferred embodiments of the invention, it is to be distinctly understood that the invention is not limited thereto, but may be otherwise variously embodied and practiced within the scope of the following claims. Accordingly,

What we claim is:

1. In a headbox of a papermaking machine, an apparatus for adjusting a diaphragm blade at a slice opening gap of the headbox of the papermaking machine, comprising:

a diaphragm blade having connecting locations;

driveable adjustable elements arranged at a predetermined spaced relationship substantially parallel to the diaphragm blade and coupled with the diaphragm blade in order to apply at said connecting locations a force upon the diaphragm blade;

a rigid stationary support;

said driveable adjusting elements being supported at said rigid stationary support;

said driveable adjusting elements comprising adjusting spindles;

adjustment motors provided for driving said adjusting spindles;

means for individually setting each of said adjustment motors to a predetermined desired thrust speed and a predetermined desired thrust distance for each respective adjusting spindle prior to starting said adjustment motors; and means for simultaneously setting said adjustment motors into operation and for simultaneously turning them off subsequent to reaching a predetermined reference position of the diaphragm blade so that each adjusting spindle covers its respective thrust distance within the same time interval.

2. The apparatus as defined in claim 1, wherein:

said adjustment motors comprise electric step motors; and wherein said means for individually setting each of said electric step motors comprises means for individually setting each electric motor to a predetermined number of steps and the frequency thereof for a predetermined time interval of an adjusting operation such that said electric step motors during said adjusting operation are collectively and simultaneously actuatable during said predetermined time interval.

* * * * *